US006766717B2

(12) United States Patent
Hu

(10) Patent No.: US 6,766,717 B2
(45) **Date of Patent: *Jul. 27, 2004**

(54) WRENCH WITH A FIXED MAXIMUM OPERATIONAL TORQUE

(76) Inventor: Bobby Hu, 8F, No. 536~1, Ta Chin Street, Taichung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 10/044,917

(22) Filed: Jan. 7, 2002

(65) Prior Publication Data

US 2003/0079578 A1 May 1, 2003

(30) Foreign Application Priority Data

Oct. 29, 2001 (TW) ..... 90218720 U

(51) Int. Cl.[7] ..... B25B 23/14
(52) U.S. Cl. ..... 81/467; 81/478
(58) Field of Search ..... 81/467, 478, 480, 81/481; 464/35, 37, 41

(56) References Cited

U.S. PATENT DOCUMENTS

| | | | | |
|---|---|---|---|---|
| 2,157,574 | A | 5/1939 | Siesel | 464/35 |
| 2,300,652 | A | 11/1942 | Cooney | 81/483 |
| 2,332,971 | A | 10/1943 | Johnson | 81/480 |
| 2,396,027 | A | 3/1946 | Spayd | 81/480 |
| 2,768,547 | A | 10/1956 | Noell | 81/480 |
| 2,924,134 | A | 2/1960 | Harmes | 81/467 |
| 3,593,542 | A | 7/1971 | Urayama | 464/37 |
| 3,651,718 | A | 3/1972 | Thomasian | 81/480 |
| 4,238,978 | A | 12/1980 | Leone | 81/480 |
| 5,152,200 | A | 10/1992 | Kaplan | 81/467 |
| 6,029,551 | A | 2/2000 | Wu | 81/475 |
| 6,076,439 | A | 6/2000 | Dzieman | 81/473 |
| 6,155,147 | A | 12/2000 | Dzieman | 81/473 |
| 6,439,086 | B1 | 8/2002 | Bahr | 81/467 |
| 6,487,943 | B1 | 12/2002 | Jansson et al. | 81/475 |
| 6,502,483 | B1 | 1/2003 | Swank et al. | 81/437 |
| 2003/0010162 | A1 | 1/2003 | Hu | |
| 2003/0010163 | A1 | 1/2003 | Hu | |
| 2003/0079577 | A1 | 5/2003 | Hu | |
| 2003/0079579 | A1 | 5/2003 | Hu | |
| 2003/0205114 | A1 | 11/2003 | Hu | |
| 2003/0205115 | A1 | 11/2003 | Hu | |

*Primary Examiner*—Lee D. Wilson
(74) *Attorney, Agent, or Firm*—Alan D. Kamrath; Nikolai & Mersereau, P.A.

(57) ABSTRACT

A wrench includes a substantially L-shaped rod and a casing. The L-shaped rod includes a first section and a second section, with a driving portion being formed on the second section for engaging with a fastener. The casing includes a receiving section for accommodating the first section of the rod and a positioning hole for rotatably receiving a portion of the second section of the rod. An engaging member is mounted in a receptacle of the casing and biased to press against the first section of the rod, thereby exerting an engaging force between the first section of the rod and the engaging member. When a rotational force applied to the casing is smaller than the engaging force, the rod is turned to hereby turn the fastener. When a rotational force applied to the casing is greater than the engaging force, the casing slides while the rod is not turned.

7 Claims, 8 Drawing Sheets

WRENCH WITH A FIXED MAXIMUM OPERATIONAL TORQUE

BACKGROUND OF THE INVENTION

1. Field of the Invention

The present invention relates to a wrench with a fixed maximum operational torque to prevent damage to the object secured by a fastener driven by the wrench.

2. Description of the Related Art

FIG. 8A of the drawings illustrates a conventional wrench 1 having a hexagonal driving portion with six planar faces 2 for engaging with six faces of a hexagonal groove in a top face of a fastener. However, slide tends to occur between the planar faces of the driving portion of the wrench 1 and the faces of the fastener. FIG. 8B illustrates a so-called TROX wrench 3 having plural arcuate faces 4 for engaging with corresponding arcuate faces in a top face of a fastener. Such a TROX wrench 3 is used to tighten important parts of a car and cutting tools. As illustrated in FIG. 9, a blade 7 is tightened to a cutting tool 5 by a bolt 6. However, the expensive blade 7 tends to be damaged when the bolt 6 is excessively tightened. But the blade 7 could fly away and thus cause injury if the bolt 6 is not tightened to the desired extent.

SUMMARY OF THE INVENTION

An object of the present invention is to provide a wrench with a fixed maximum operational torque such that when the torque applied by the user is greater than the maximum operational torque, the wrench slides and the fastener is not turned. Thus, damage to the object secured by the fastener resulting from over-tightening is prevented.

Another object of the present invention is to provide a wrench with a fixed maximum operational torque that can be altered in response to the actual use.

A wrench in accordance with the present invention comprises a substantially L-shaped rod and a casing. The L-shaped rod comprises a first section and a second section, a driving portion being formed on the second section for engaging with a fastener. The casing includes a receiving section for accommodating the first section of the rod and a positioning hole for rotatably receiving a portion of the second section of the rod. The receiving section of the casing is configured to allow relative pivotal movement between the casing and the rod. The casing further includes a receptacle that preferably extends along an axis offset from a longitudinal axis of the first section of the rod. An engaging member is mounted in the receptacle of the casing and biased to press against the first section of the rod, thereby exerting an engaging force between the first section of the rod and the engaging member. When a rotational force applied to the casing is smaller than the engaging force, the rod is turned to thereby turn the fastener. When a rotational force applied to the casing is greater than the engaging force, the casing slides while the rod is not turned.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
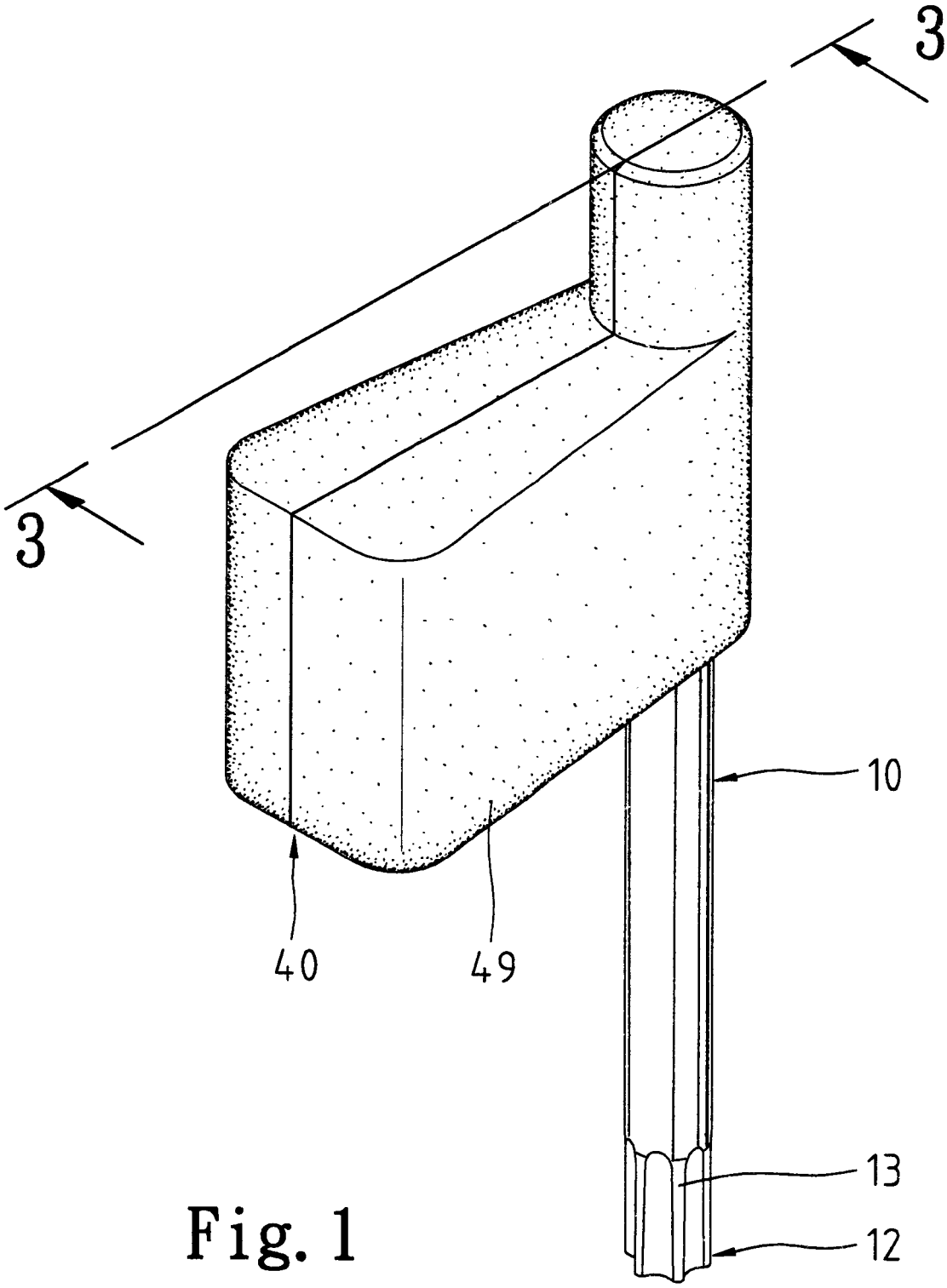
FIG. 1 is a perspective view of a wrench in accordance with the present invention.
Figure 2:
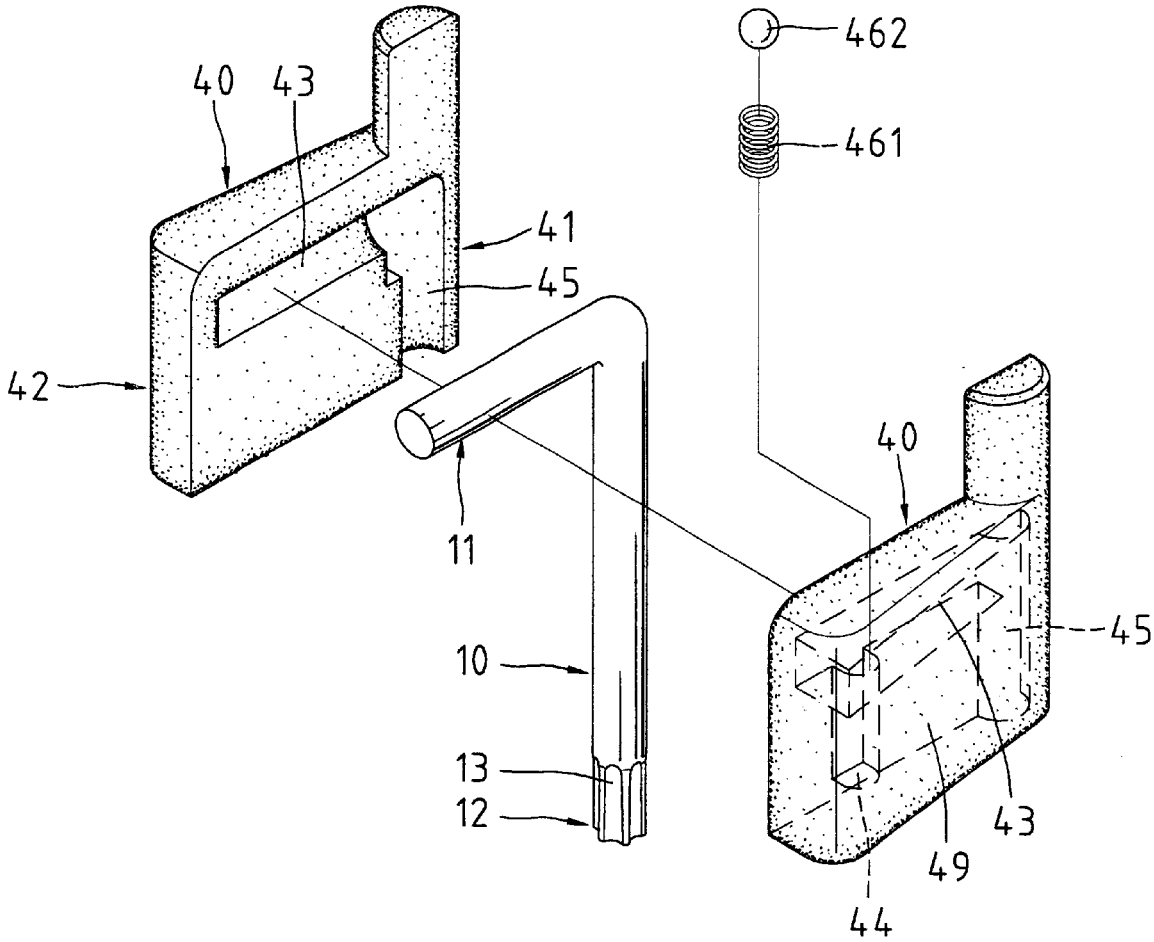
FIG. 2 is an exploded perspective view of the wrench in accordance with the present invention.

Referring to FIGS. 1 and 2, a wrench in accordance with the present invention generally includes a rod 10 and a casing 40. The rod 10 is substantially L-shaped and comprises a first section 11 and a second section 12 with a driving portion 13 for engaging with a fastener. In this embodiment, the driving portion 13 is shaped as a TROX type wrench.

Figure 3:
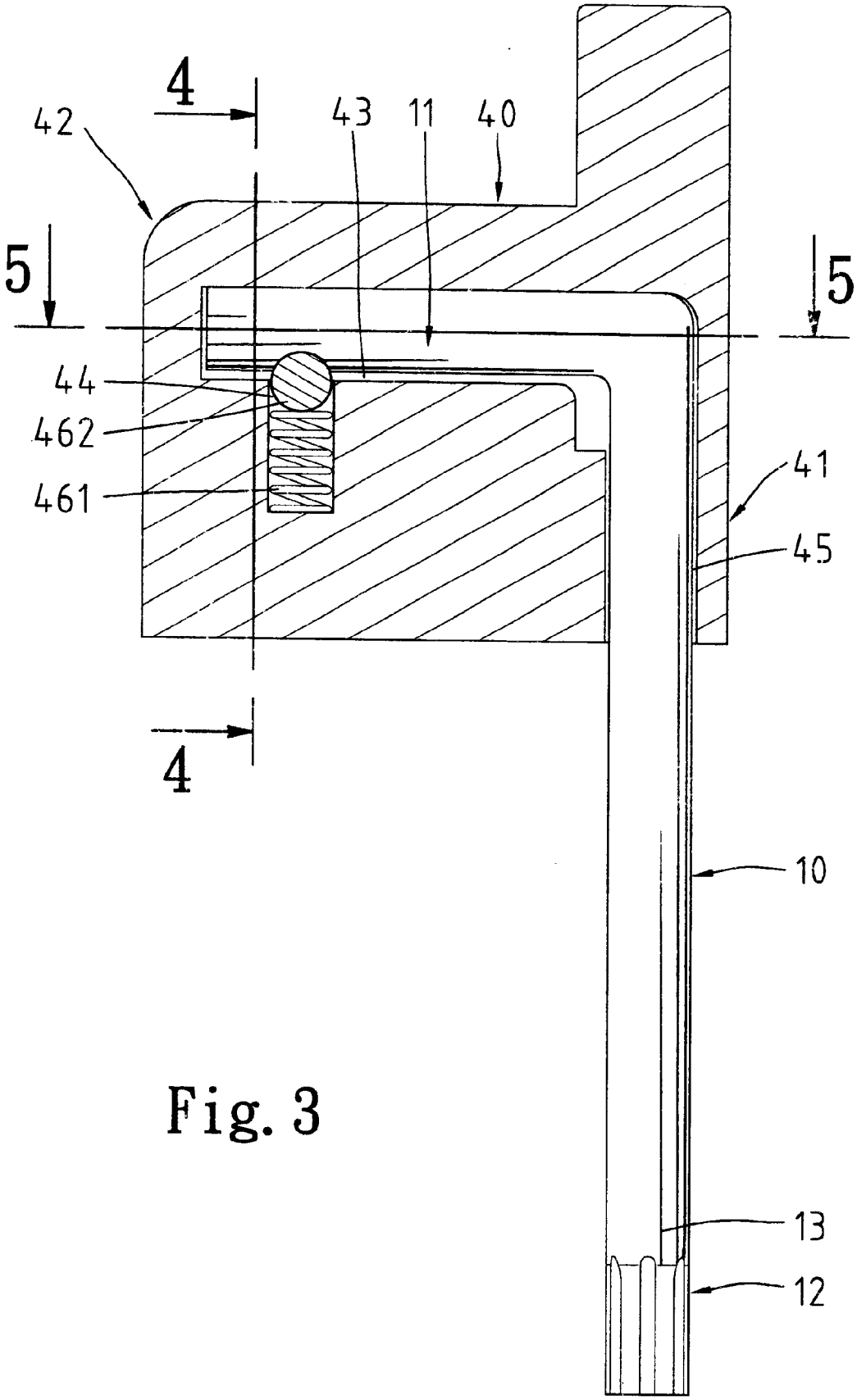
FIG. 3 is a sectional view taken along plane 3—3 in FIG. 1.

In this embodiment, the casing 40 is comprised of two half casings each having a first end 41 and a second end 42. A grip portion 49 is formed on the second end 42 of each casing half for manual turning operation. A receiving compartment 43 is defined in each casing half for accommodating the first section 11 of the rod 10. Referring to FIGS. 2 and 3, a positioning hole 45 is defined in the first end 41 of each casing half and extends along a direction orthogonal to the receiving compartment 43 for receiving a portion of the second section 12 of the rod 10. In an alternative embodiment of the invention, the two casing halves together define a receiving compartment 43 for receiving the first section 11 of the rod 10 while allowing relative pivotal movement between the casing 40 and the rod 10. The two casing halves also together define a positioning hole 45 that is communicated with the receiving compartment 43 and extends along a direction orthogonal to the receiving compartment 43. A portion of the second section 12 of the rod 10 is rotatably received in the positioning hole 45.

Figure 4:
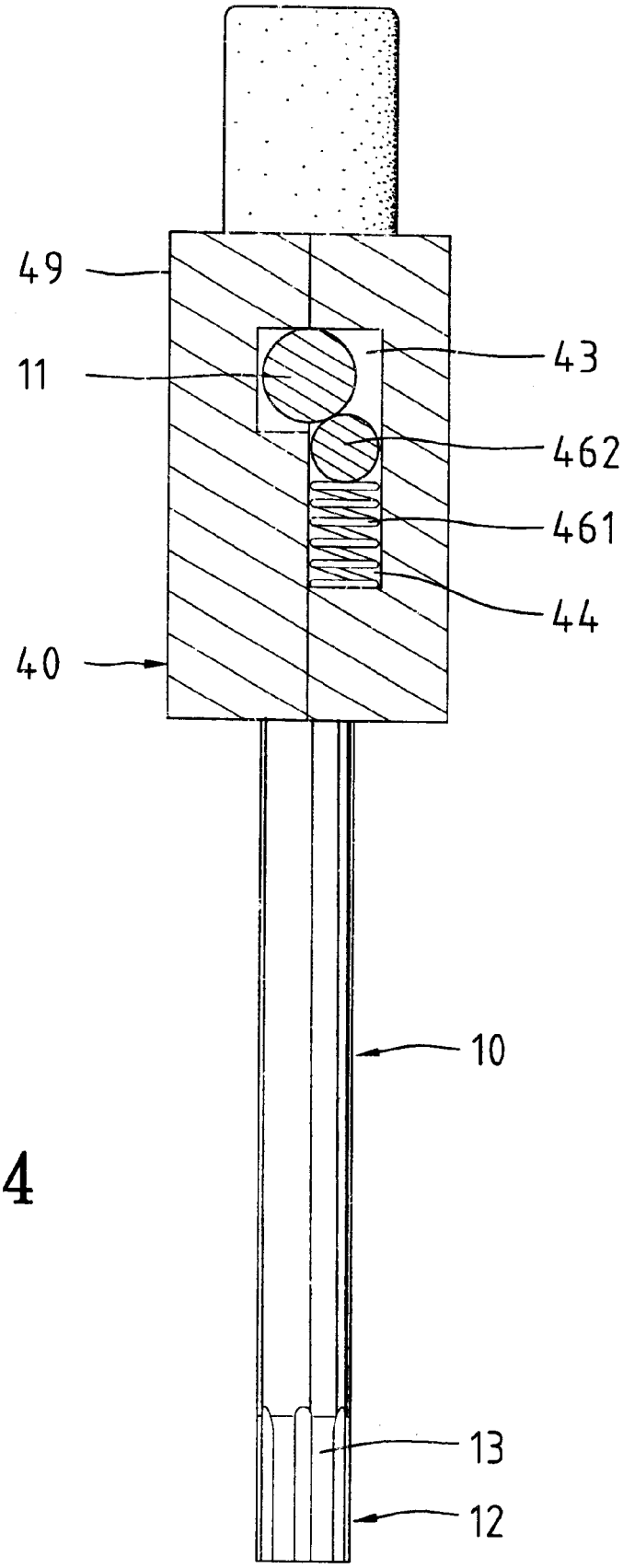
FIG. 4 is a sectional view taken along plane 4—4 in FIG. 3.
Figure 5:
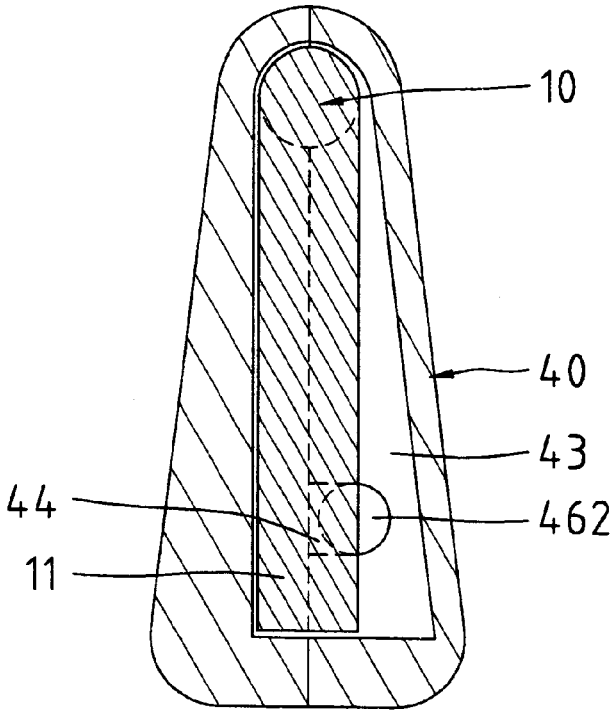
FIG. 5 is a sectional view taken along plane 5—5 in FIG. 3.

One of the casing halves further includes a receptacle 44 for receiving a biasing means (such as an elastic element 461) and an engaging member (such as a ball 462). The receptacle 44 is communicated with the receiving compartment 43 of the associated casing half. As illustrated in FIGS. 4 and 5, the receptacle 44 preferably extends along an axis offset from a longitudinal axis of the first section 11 of the rod 10. Referring to FIGS. 3 through 5, the ball 462 is biased by the elastic element 461 to press against the first section 11 of the rod 10. Namely, a predetermined engaging force exists between the first section 11 of the rod 10 and the ball 462 under the action of the elastic element 461.

When driving a TROX type bolt (not shown) for a cutting tool (not shown), the driving portion 13 of the second end 12 of the rod 10 is engaged with the bolt, and the casing 40 is then turned by means of gripping and turning the grip portion 49. Referring to FIGS. 4 and 5, when the rotational force applied to the wrench is smaller than the predetermined engaging force between the first section 11 of the rod 10 and the ball 462, the rod 10 turns together with the casing 40 to thereby drive the bolt.

Figure 7:
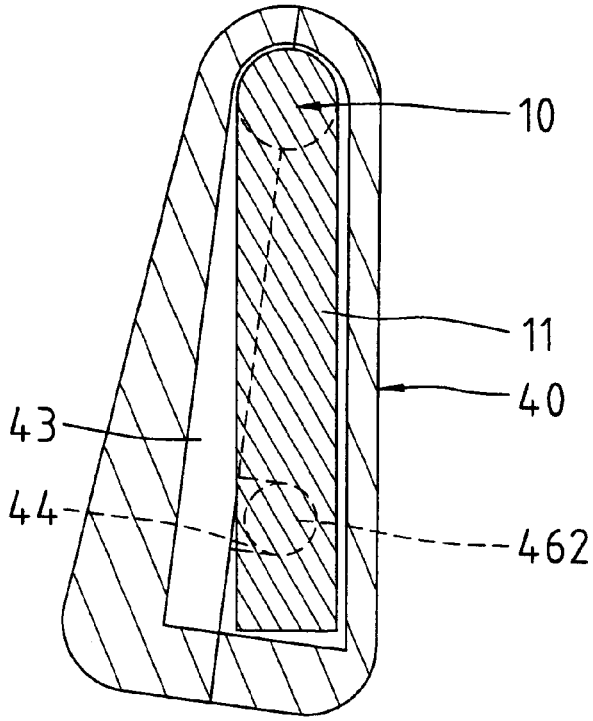
FIG. 7 is a view similar to FIG. 5, illustrating operation of the wrench in accordance with the present invention.
Figure 6:
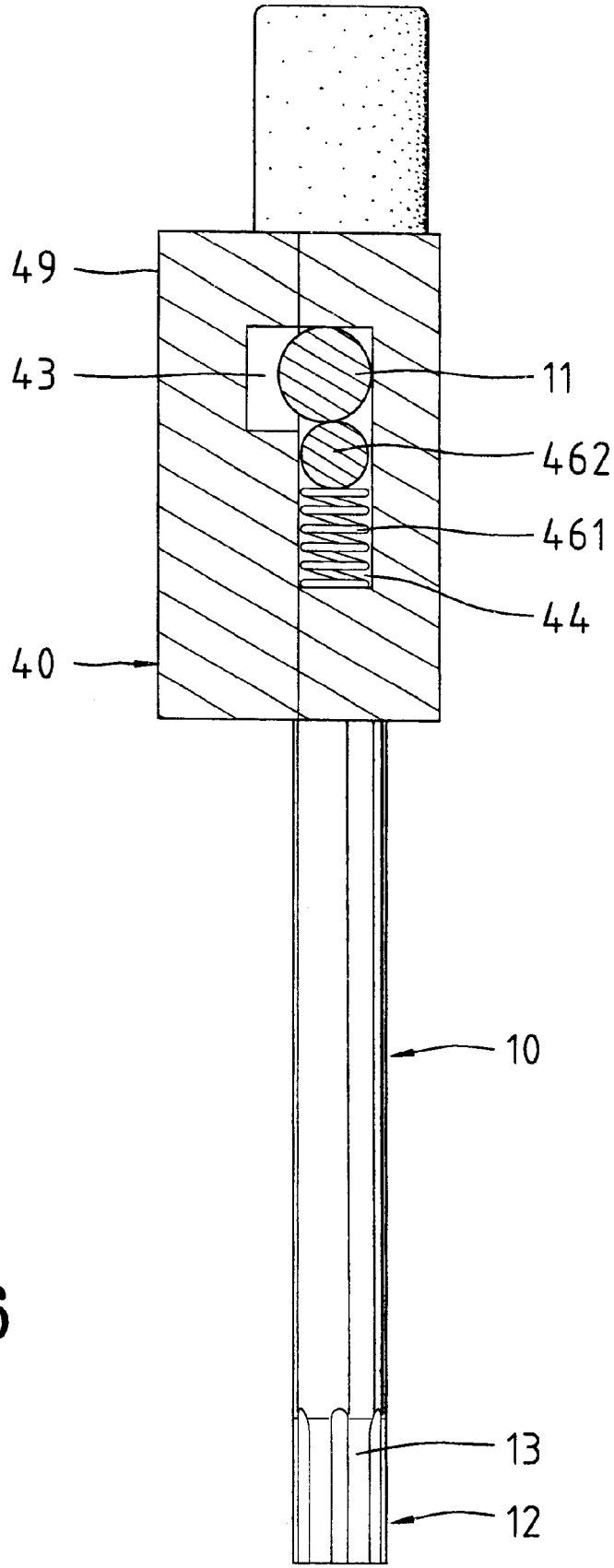
FIG. 6 is a view similar to FIG. 4, illustrating operation of the wrench in accordance with the present invention.
Figure 8A:
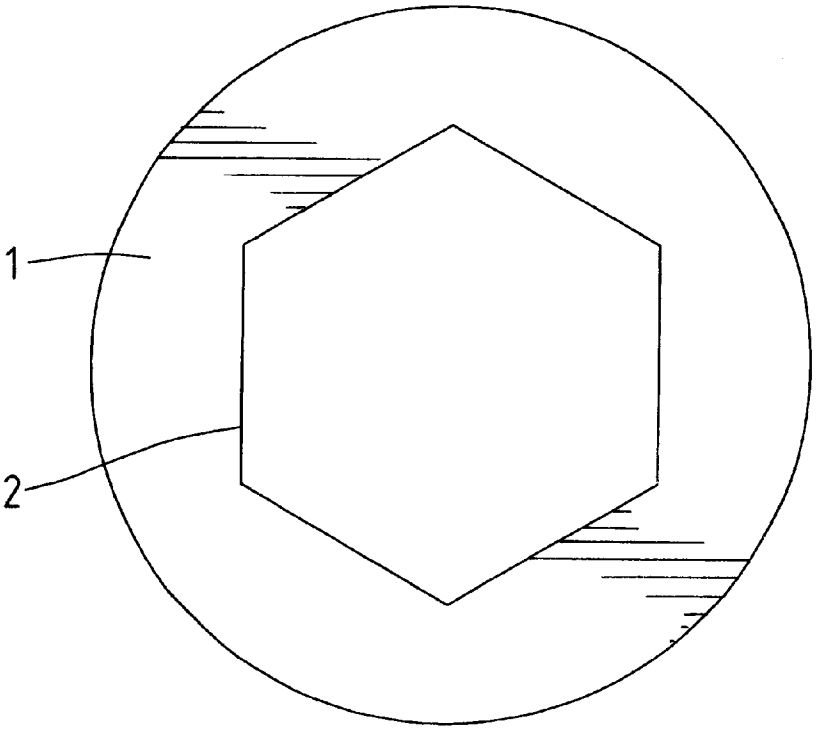
Fig. 8A PRIOR ART
FIG. 8A is an end view of a conventional hexagonal wrench.
Figure 8B:
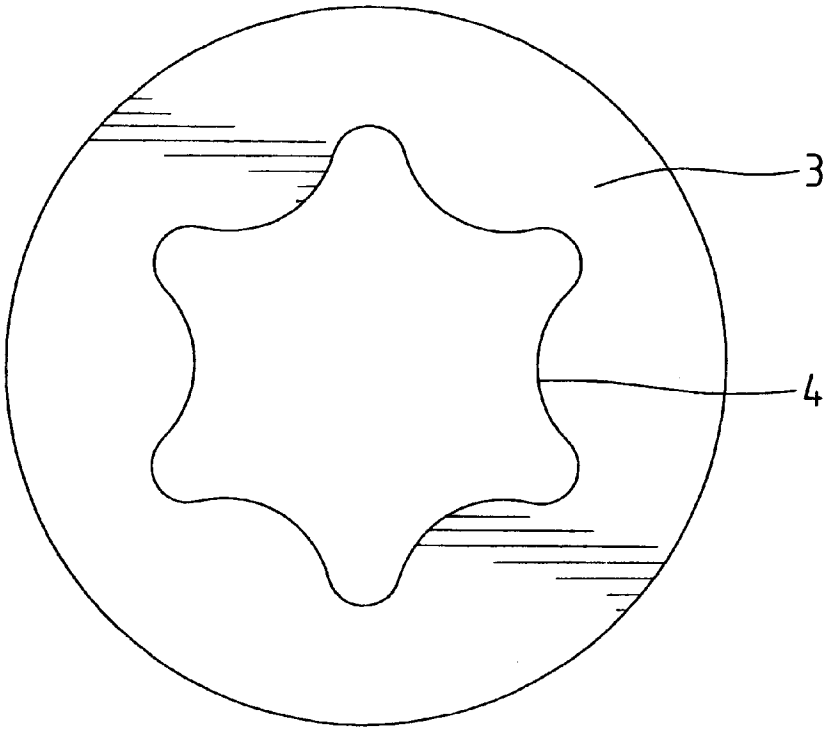
Fig. 8B PRIOR ART
FIG. 8B is an end view of a conventional TROX wrench.
Figure 9:
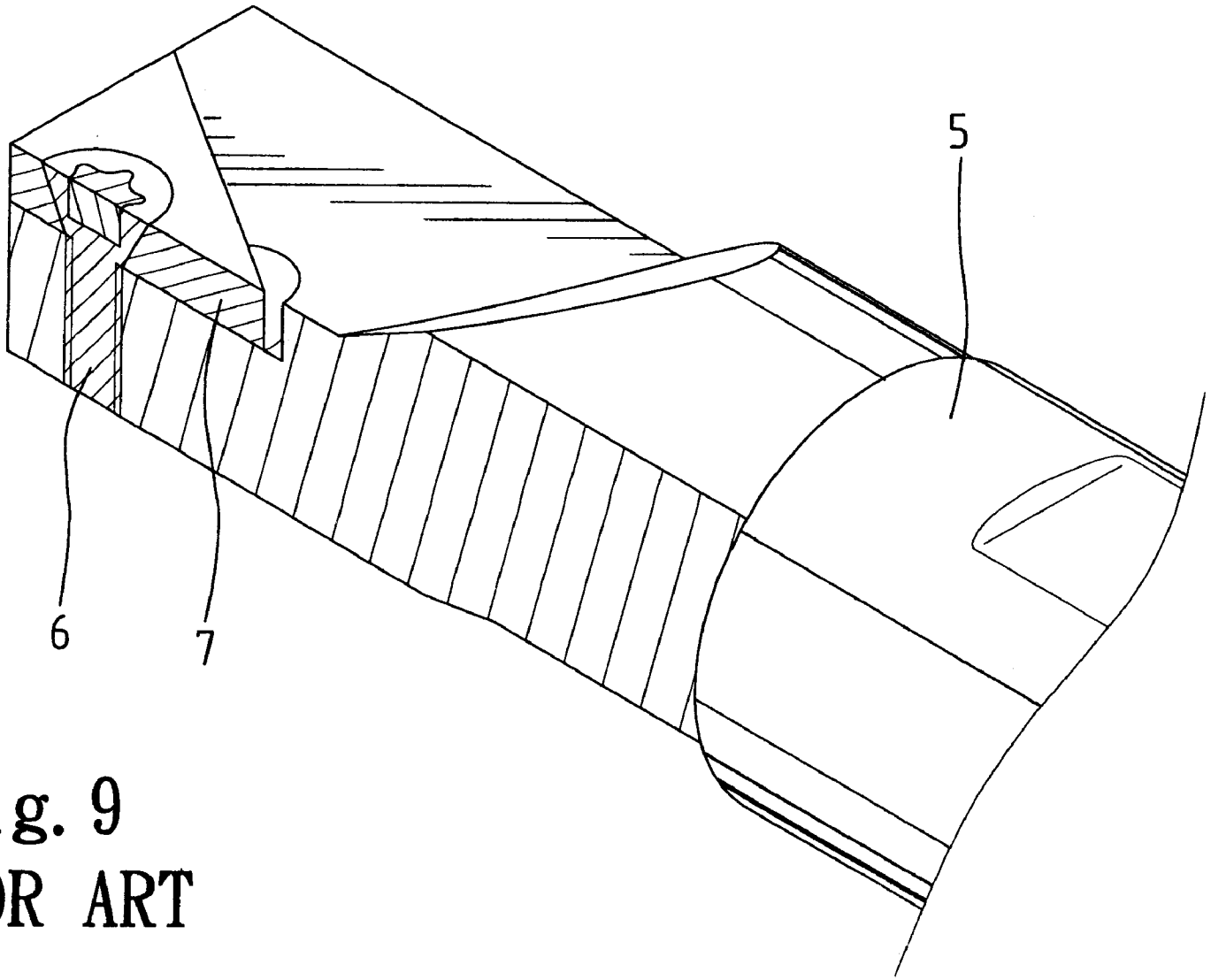
Fig. 9 PRIOR ART
FIG. 9 is a perspective view, partly cutaway, of a cutting tool.

When the rotational force applied to the wrench is greater than the predetermined engaging force between the first section 11 of the rod 10 and the ball 462, as illustrated in FIGS. 6 and 7, the elastic element 461 is compressed to absorb the excessive amount of rotational force. Since the elastic element 461 is compressed, a sliding action is generated between the ball 462 and the first section 11 of the rod 10. Thus, the ball 462 slides relative to the first section 11 of the rod 10; namely, the rod 10 is not turned. As a result, the bolt is not turned. The casing 40 returns to its original position shown in FIGS. 4 and 5 under the action of the elastic element 461 when the rotational force is released.

It is noted that the engaging force, which largely depends on the elastic coefficient of the elastic element 461, determines a maximum operational torque for turning the rod 10. Namely, when the torque applied to the casing 40 is smaller than the maximum operational torque, the rod 10 is turned, and when the torque applied to the casing 40 is greater than the maximum operational torque, the rod 10 is not turned. During tightening of the bolt, the bolt before being tightened is turned by means of applying a torque smaller than the maximum operational torque. When the bolt is tightened, the torque required to turn the casing 40 would be greater than the maximum operational torque such that the casing 40 slides. Thus, the user will notice the sliding motion of the casing 40 and be aware of tightening of the bolt. As a result, damage to the bolt and the cutting tool resulting from over-tightening is avoided. The maximum operational torque can be altered by means of selecting elastic elements of different elastic coefficients. The maximum operational torque is a constant and thus allows accurate operation. This advantageous design can be used in a limited space, and the manufacturing cost of the wrench is largely reduced.

Although the invention has been explained in relation to its preferred embodiment, it is to be understood that many other possible modifications and variations can be made without departing from the scope of the invention as hereinafter claimed.

What is claimed is:

1. A wrench comprising:

a substantially L-shaped rod comprising a first section and a second section, a driving portion being formed on the second section for engaging with a fastener;

a casing including a receiving section for accommodating the first section of the rod and a positioning hole for rotatably receiving a portion of the second section of the rod, the receiving section of the casing being configured to allow relative pivotal movement between the casing and the rod, the casing further including a receptacle communicated with the first section of the rod;

an engaging member mounted in the receptacle of the casing; and means for biasing the engaging member to press against the first section of the rod, thereby exerting an engaging force between the first section of the rod and the engaging member;

wherein when a rotational force applied to the casing is smaller than the engaging force, the rod is turned to thereby turn the fastener; and wherein when a rotational force applied to the casing is greater than the engaging force, the casing slides while the rod is not turned.

2. The wrench as claimed in claim 1, wherein the engaging member is a ball, and the biasing means is an elastic element mounted in the receptacle.

3. The wrench as claimed in claim 1, wherein the casing comprises a grip portion.

4. The wrench as claimed in claim 1, wherein the casing is comprised of two casing halves.

5. The wrench as claimed in claim 4, wherein the receptacle is defined in one of the casing halves.

6. The wrench as claimed in claim 5, wherein the receptacle of the casing extends along an axis offset from a longitudinal axis of the first section of the rod.

7. The wrench as claimed in claim 1, wherein the receptacle of the casing extends along an axis offset from a longitudinal axis of the first section of the rod.

* * * * *